US011060760B2

(12) United States Patent
Wickelmaier et al.

(10) Patent No.: US 11,060,760 B2
(45) Date of Patent: Jul. 13, 2021

(54) PRESSURE COMPENSATION AND MIXING DEVICE HAVING A MIXING UNIT AND A PRESSURE COMPENSATION UNIT

(71) Applicant: Truma Gerätetechnik GmbH & Co. KG, Putzbrunn (DE)

(72) Inventors: Peter Wickelmaier, Munich (DE); Johannes Laging, Munich (DE)

(73) Assignee: TRUMA GERÄTETECHNIK GMBH & CO. KG, Putzbrunn (DE)

( * ) Notice: Subject to any disclaimer, the term of this patent is extended or adjusted under 35 U.S.C. 154(b) by 224 days.

(21) Appl. No.: 15/674,249

(22) Filed: Aug. 10, 2017

(65) Prior Publication Data

US 2017/0363321 A1 Dec. 21, 2017

Related U.S. Application Data

(63) Continuation of application No. 14/031,237, filed on Sep. 19, 2013, now Pat. No. 9,765,990.

(30) Foreign Application Priority Data

Jul. 9, 2013 (DE) ..... 202013006208.8

(51) Int. Cl.

| | |
|---|---|
| ***F24H 9/00*** | (2006.01) |
| ***E03C 1/044*** | (2006.01) |
| ***F24D 3/10*** | (2006.01) |

(52) U.S. Cl.

CPC ..... *F24H 9/0005* (2013.01); *E03C 1/044* (2013.01); *F24D 3/1008* (2013.01); *F24D 3/1091* (2013.01); *Y10T 137/6416* (2015.04); *Y10T 137/87652* (2015.04)

(58) Field of Classification Search

CPC .... F24D 3/1008; F24D 3/1091; F24H 9/0005; Y10T 137/87652; Y10T 137/6416; E03C 1/044

See application file for complete search history.

(56) References Cited

U.S. PATENT DOCUMENTS

| | | | | |
|---|---|---|---|---|
| 3,486,530 A | | 12/1969 | Mercier | |
| 3,868,972 A | * | 3/1975 | Zirps | F15B 1/18 138/30 |
| 4,324,228 A | | 4/1982 | Shippee | |
| 4,827,962 A | * | 5/1989 | Picton | F16K 17/38 122/504.1 |

(Continued)

FOREIGN PATENT DOCUMENTS

| | | | |
|---|---|---|---|
| CN | 2725779 | Y | 9/2005 |
| CN | 102235563 | A | 11/2011 |

(Continued)

*Primary Examiner* — Steven S Anderson, II

(74) *Attorney, Agent, or Firm* — Murphy, Bilak & Homiller, PLLC

(57) ABSTRACT

A pressure compensation and mixing device for a fluid heater has a mixing unit and a pressure compensation unit. The mixing unit is configured to mix a fluid guided in the mixing unit. The pressure compensation unit is configured to restrict pressure rising in the fluid. The mixing unit and the pressure compensation unit are integrated in a container unit. A bottom side of the container unit is closed by a bottom portion on which at least one connection is located via which the fluid may be discharged.

11 Claims, 11 Drawing Sheets

(56) References Cited

U.S. PATENT DOCUMENTS

| | | | | |
|---|---|---|---|---|
| 6,508,208 | B1 * | 1/2003 | Frasure | F24H 1/207 122/380 |
| 8,276,548 | B2 | 10/2012 | Consadori et al. | |
| 8,523,001 | B2 * | 9/2013 | Acker | F16J 3/02 220/581 |
| 2012/0097746 | A1 | 4/2012 | Haws | |

FOREIGN PATENT DOCUMENTS

| | | | | | |
|---|---|---|---|---|---|
| DE | 2817538 | A1 | * | 10/1979 | F24D 3/1066 |
| DE | 9101643 | U1 | | 6/1991 | |
| DE | 19504750 | A1 | | 8/1996 | |
| DE | 19818281 | A1 | | 7/1999 | |
| DE | 20002709 | U1 | | 9/2000 | |
| EP | 2372258 | A1 | | 10/2011 | |
| FR | 2558245 | A1 | | 7/1985 | |
| GB | 688059 | A | * | 2/1953 | F24D 3/1008 |
| GB | 688059 | A | | 2/1953 | |
| GB | 927203 | A | * | 5/1963 | F24D 3/1008 |
| GB | 927203 | A | | 5/1963 | |
| GB | 936541 | A | | 9/1963 | |

* cited by examiner

PRESSURE COMPENSATION AND MIXING DEVICE HAVING A MIXING UNIT AND A PRESSURE COMPENSATION UNIT

PRIORITY CLAIM

This application is a Continuation of U.S. application Ser. No. 14/031,237 filed on 19 Sep. 2013, which in turn claims priority to German Utility Model No. 20 2013 006 208.8, filed on 9 Jul. 2013, the content of both of said applications incorporated herein by reference in their entirety.

TECHNICAL FIELD

The invention relates to a fluid heater as well as to a pressure compensation and mixing device.

BACKGROUND

Fluid heaters are for example known as continuous flow heaters and are used for heating of water, which is used for sanitary purposes (e.g. shower, bath tub, sink, or hand wash basin). Typically a fluid heater has a heat source, for example a gas burner or an electric heating, and a heat exchanger. Through the heat exchanger a fluid flows, e.g. water from water supply mains or from a storage tank, wherein the water gets heated while flowing through the heat exchanger.

Depending on the water and heat demand the fluid heater or the heat source in the fluid heater is operated continuously or—at smaller heat demands—in cycle modus. The electric heating or the burner is turned on only, when a heat demand is given because of a demand by a user. The heat demand (hot water demand) is typically controlled by a flow switch.

During the operation of a fluid heater fluctuations of the outlet temperature at the tap connections may occur. During the duration of output these fluctuations result as more or less strong departures from a set temperature predetermined at the device. In this process, in particular outlet temperature peaks are unpleasant for the user, since a contact with the too hot water may lead to scalding. Also temperatures which are too low for a short time are at least inconvenient for the user.

Fluctuations of the outlet temperature may on the one hand be caused by the user of the fluid heater himself, for example by a change of the amount of water throughput during showering, or on the other hand by basic device and system conditions, which are not influenceable by the user, for example by a fluctuating gas pressure at the gas burner.

If the water is turned off during a shower for a short term or if the throughput is strongly reduced, the excess amount of heat, which is intermediately stored in the heat exchanger or the heat transmitter respectively, is introduced into the water. The amount of heat introduced by the gas burner or the electric heating into the heat exchanger is therefore also then transmitted into the water if no water throughput is happening anymore. This leads to a rapid and short term overshoot of the hot water temperature above the set temperature, and thus to undesirable temperature peaks.

If the tap is reopened after a showering stop it takes a given time offset until the gas burner transmits the needed amount of heat to the heat exchanger and thus to the water. The time offset results from the time which is necessary for firing and starting the burner as well as from the heating of its elements. Depending on the amount of throughput and the time offset this results in an undershoot of the water temperature with respect to the set temperature. The resulting surprisingly cold water is experienced by the user as inconvenient, too.

Fluid heaters are versatile used in stationary facilities (for example in bathrooms). But they can also be used in mobile areas, as for examples caravans, motorhomes or boats. The operation of fluid heater systems in mobile applications requires a special consideration of the fluctuating material and/or operation flows, since in a mobile application a central supply (for example gas supply, electric power supply, water supply) normally has to serve for several users. This may cause additional fluctuations of the hot water temperature at the tap connection, which are not expected by the user and therefore experienced as inconvenient.

From U.S. Pat. No. 8,276,548 B2 a continuous flow heater for mobile applications is known.

In DE-G-91 01 643 a water heating facility with a buffer storage is described, which is used for homogenization of the water temperature at the outlet.

Mobile applications have the additional problem that the available space is very restricted in most cases. Possible buffer or compensating reservoirs for homogenization of the temperature can therefore not readily placed in the scarce available space.

Moreover, in particular in small systems during heating the problem can appear that the water pressure rises with increasing heating such that water escapes via a pressure relief valve. Especially with the limited water reserves in mobile applications this water loss is particularly detrimental.

SUMMARY

Embodiments described herein provide a fluid heater which operates resource preservingly and from which water with a temperature and pressure as constant as possible can be output.

In one embodiment, a pressure compensation and mixing device for a fluid heater is provided. The pressure compensation and mixing device comprises a mixing unit and a pressure compensation unit. The mixing unit is configured to mix a fluid guided in the mixing unit. The pressure compensation unit is configured to restrict the pressure rising in the fluid. The mixing unit and the pressure compensation unit are integrated in a container unit.

By using the mixing unit it is possible to mix the fluid heated by the fluid heater, thus in particular water. By this process it can be achieved that hotter fluid gets mixed with cooler fluid such that the overall temperature gets more homogeneous.

This aspect is in particular useful for the aforementioned problem, if during turning off of the fluid heater heat is introduced via the heat exchanger into the water remaining in the heat exchanger such that undesired temperature peaks are generated. At the subsequent mixing of the overheated water with the cooler water still present in the system by means of the mixing unit temperature peaks can be reduced, which enhances at least the comfort.

The pressure compensation unit is able to restrict the pressure in the fluid in order to avoid damages of components of the fluid heater or the whole water supply facilities. A pressure restriction may be necessary in case of a strong heating of the water as well as in case of freezing of the facility.

By integrating the mixing unit and the pressure compensation unit in a common container unit an especially compact structure is achieved which is in particular useful for the usage in mobile facilities, as for example motorhomes. Typically, a pressure compensation unit is provided spatially separated from a fluid heater. By integration it with a mixer unit of the fluid heater the available space can be used optimally.

To this end, the mixing unit and the pressure compensation unit may have a common fluid receiving guiding housing. The mixing unit and the pressure compensation unit are then located within a housing, which simultaneously guides the fluid or the water, too.

The mixing unit may have a fluid receiving mixing volume, while the pressure compensating unit has an air receiving pressure compensation volume. To this end, the mixing volume and the pressure compensation volume may adjoin each other directly, wherein they are at least partially separated from each other by a common separation wall. The mixing volume and the pressure compensation volume are then arranged directly next to each other and thus at least partially only separated from each other by the separation wall. By this an especially compact structure may be achieved.

The pressure compensation unit may be encompassed by the mixing unit at least partially. In an inverted variant, the mixing unit may be at least partially encompassed by the pressure compensation unit. Hence, one unit may encompass the respective other unit at least partially in order to achieve the compact structure.

In particular, the mixing volume and the pressure compensation volume may be arranged horizontally next to each other.

The pressure compensation unit may be at least partially arranged inside the mixing unit. In another variant, it is just as well possible that the mixing unit is at least partially arranged inside the pressure compensation unit.

The mixing unit comprises the mixing volume with at least one inlet and at least one outlet. To this end the mixing unit may have a mixer container for receiving the mixing volume, wherein the mixing container has the inlet and the outlet. In the mixing volume or the mixing container the actual mixing process happens, wherein the fluid is let in by the inlet and let out by the outlet. As will be detailed in the following, a particularly efficient flow may be achieved by an appropriate design of the mixing volume or the mixing container, which supports the mixing process inside the mixing volume.

In variants it is possible that more inlets and/or more outlets are provided on the mixing volume. The choice depends on the respective conditions and requirements as well as on the dimensioning.

The mixing volume or the mixing container encompassing the mixing volume may have an essentially (partially) rotationally symmetrical, for example cylindrical or elliptical, basic body, wherein primarily the design of the internal contour of the mixing volume is essential. The internal contour of the mixing volume should therefore be formed as homogeneous as possible, or should have a uniform curvature with smooth transitions in order to allow for an unobstructed flow—as will be detailed in the following.

The main or central or rotational axis of the mixing container may be vertically but may also be arranged horizontally.

The mixing unit may be a swirl mixing unit and may have a swirl generation unit for generating a swirl flow of the fluid in the mixing volume. By means of the swirl generating unit it is therefore achieved that a fluid flowing in the mixing volume forms a swirl flow which results in a particular effective mixing of the fluid.

The swirl generating unit may be formed in various manners. E.g. the swirl generating unit may have a wing wheel arranged in the mixing volume. The swirl generating unit may just as well comprise means which guide or redirect the fluid flow at the in- and outlet such that a swirl flow is resulting.

In one embodiment the swirl generating unit may be formed such that the inlet is arranged tangentially at the mixing volume or the mixing container such that the fluid let in by the inlet flows tangentially into the mixing volume. On the other hand, the outlet may be arranged axially in the mixing volume such that the fluid let out through the outlet flows axially out of the mixing volume. To this end, the outlet may be arranged on the middle, main, or rotation axis of the inner contour of the mixing volume, but may also be arranged offset to this axis. For a substantially cylindrical mixing volume the outlet may thus be arranged on the rotation axis of the cylinder or also displaced to the rotation axis. The axis of the outlet is then parallel or coaxial to the rotation axis.

In particular, the outlet may be provided on a top side of the mixing volume and may lead the fluid vertically upwards out of the mixing volume, while the inlet is provided in an upper region of the mixing volume tangentially to a lateral side of the e.g. rotationally symmetrical basic body.

In a variant, the outlet may be provided on a bottom side of the mixing volume and the fluid may be let out downwards out of the mixing volume, while the inlet is provided in a lower region of the mixing volume at a lateral side of a mixing container encompassing the mixing volume. This variant has the advantage that the fluid can be let out via the inlet or the outlet while the system is not in use. An additional fluid outlet is not required. Moreover, the outlet is frequently rinsed during operation and can therefore not close.

The outlet may extend via an extraction line also further into the inside of the mixing volume such that the actual extraction position at which the fluid changes from the mixing volume into the outlet may be in a region different from the position at which the outlet leaves the mixing container through its walls. Therefore, the extraction position may, e.g. also in case that the outlet is arranged at a bottom side of the mixing volume, be located in the upper region of the mixing volume if the extraction line is led upwards inside of the mixing volume accordingly.

By this arrangement of inlet and outlet of the mixing volume it is possible to achieve a specific fluid-flow inside the mixing volume, which allows for an advantageous mixing of the fluid in the mixing volume. For example it has been shown that the fluid flowing in through the tangential inlet performs a helical or cyclone or swirl flow inside the mixing volume such that an effective mixing is achieved. The fluid flowing in through the inlet into the upper part of the mixing volume performs first an exterior helical flow along the inner contour of the mixing volume from the upper region into the lower region (inversion region) of the mixing volume. There in the inversion region the diameter of the flow reduces from an exterior to an internal flow which flows then in the inner region of the mixing volume helically upwards to the outlet, too.

In another embodiment, e.g. with more in- and/or outlets or with horizontally aligned main axis of the mixing volume, a helical or cyclone or swirl flow may form just as well, which is then aligned accordingly, i.e. for example along a horizontal swirl axis.

In another embodiment the mixing unit is a jet mixing unit, wherein the inlet is arranged at a side of the mixing volume and the outlet is arranged at the same side of the mixing volume. Then, the inlet and the outlet may be arranged coaxially with respect to each other such that either the inlet encompasses the outlet circularly or the outlet encompasses the inlet circularly. Using the jet mixing unit an effective mixing of the fluid in the mixing volume may be achieved just as well.

In a further development, the inlet and the outlet may be arranged together at the top side or the bottom side of the mixing volume of the jet mixing unit.

The pressure compensation unit may have a chamber with at least one opening for receiving of the pressure compensation volume. The opening may be provided in a lower region of the chamber such that in an upper region of the chamber above the opening the pressure compensation volume is includable as an air volume, wherein the chamber is in direct connection with the mixing volume via the opening. The mixing volume or the mixing container and the pressure compensation volume are connected with each other such that a change of the fluid pressure in the mixing volume can be compensated by the pressure compensation volume in the chamber. The pressure compensation volume or the air volume comprised therein contained in the chamber gets compressed in case of a rising of the fluid pressure, which results in a reduction of pressure peaks. When the air volume expands, the pressure in the fluid may rise again.

The chamber receiving the pressure compensation volume may have a substantially rotationally symmetrical, for example cylindrical or dome-shaped, basic body, wherein the chamber may be arranged inside of the mixing volume. Alternatively, the chamber may have a circular structure which encompasses the mixing volume.

To this end, it is appropriate to arrange the chamber and the mixing volume concentrically with respect to each other, which means, that they are quasi inserted into each other, in order to achieve the desired compact structure.

In a variant the pressure compensation unit may have two chambers, wherein an inner chamber is arranged inside the mixing volume and an outer chamber encompasses the mixing volume at least partially outside. By providing two chambers and accordingly also two pressure compensation volumes a sufficiently large volume may be achieved in order to achieve effective pressure compensation.

The mixing container with the mixing volume on the one hand as well as the chamber with the air or pressure compensation volume on the other hand may have a substantially rotationally symmetrical basic body. The basic body may e.g. correspond to a cylinder with a circular layout. Just as well, it is also possible to choose an elliptical, quadratic, rectangular or also an otherwise angled layout. Layouts without angles (circle or ellipse for a cylinder) have the advantage that a relatively continuous inner form of especially the mixing container may be achieved such that the desired swirl or cyclone flow may form.

According to the embodiment also different basic forms for the mixing container and the chamber may be combined with each other, e.g. a circular cylinder for the mixing container with an elliptical cylinder for the chamber or cube-shaped containers.

A fluid heater may use the pressure compensation and mixing unit described above, wherein the fluid heater has a heat source for generating heat, a heat exchanger for transmitting the heat into a fluid flowing through the heat exchanger and a guiding unit for guiding the fluid from the heat exchanger to the pressure compensation and mixing unit.

The pressure compensation and mixing unit may be integrated into the fluid heater and may be arranged as close as possible to the heat exchanger in order to save available space.

In this structure the guiding unit may be formed for guiding the fluid from the heat exchanger to the inlet at the mixing volume.

The fluid heater may, e.g. as continuous flow heater, heat water which is supplied from a water supply (water reservoir, public water mains, etc.) and which shall be used for, e.g. sanitary uses. Just as well, the fluid heater may also be used for regularly heating a circulating fluid without extracting the fluid, e.g. in a heat circuit.

Those skilled in the art will recognize additional features and advantages upon reading the following detailed description, and upon viewing the accompanying drawings.

BRIEF DESCRIPTION OF THE DRAWINGS

The elements of the drawings are not necessarily to scale relative to each other. Like reference numerals designate corresponding similar parts. The features of the various illustrated embodiments can be combined unless they exclude each other. Embodiments are depicted in the drawings and are detailed in the description which follows.

DETAILED DESCRIPTION

Figure 1:
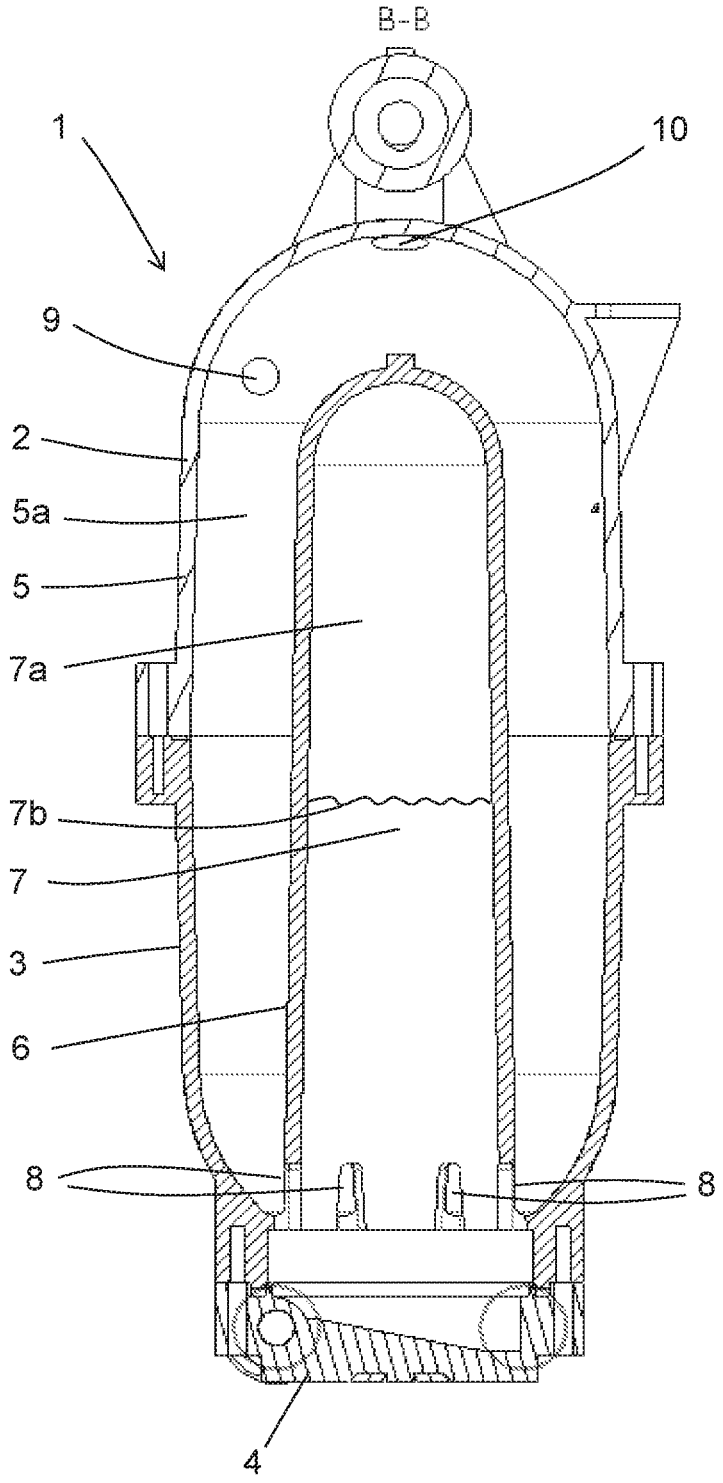
FIG. 1 illustrates an embodiment of a pressure compensation and mixing device in a cross-sectional view.
Figure 2:
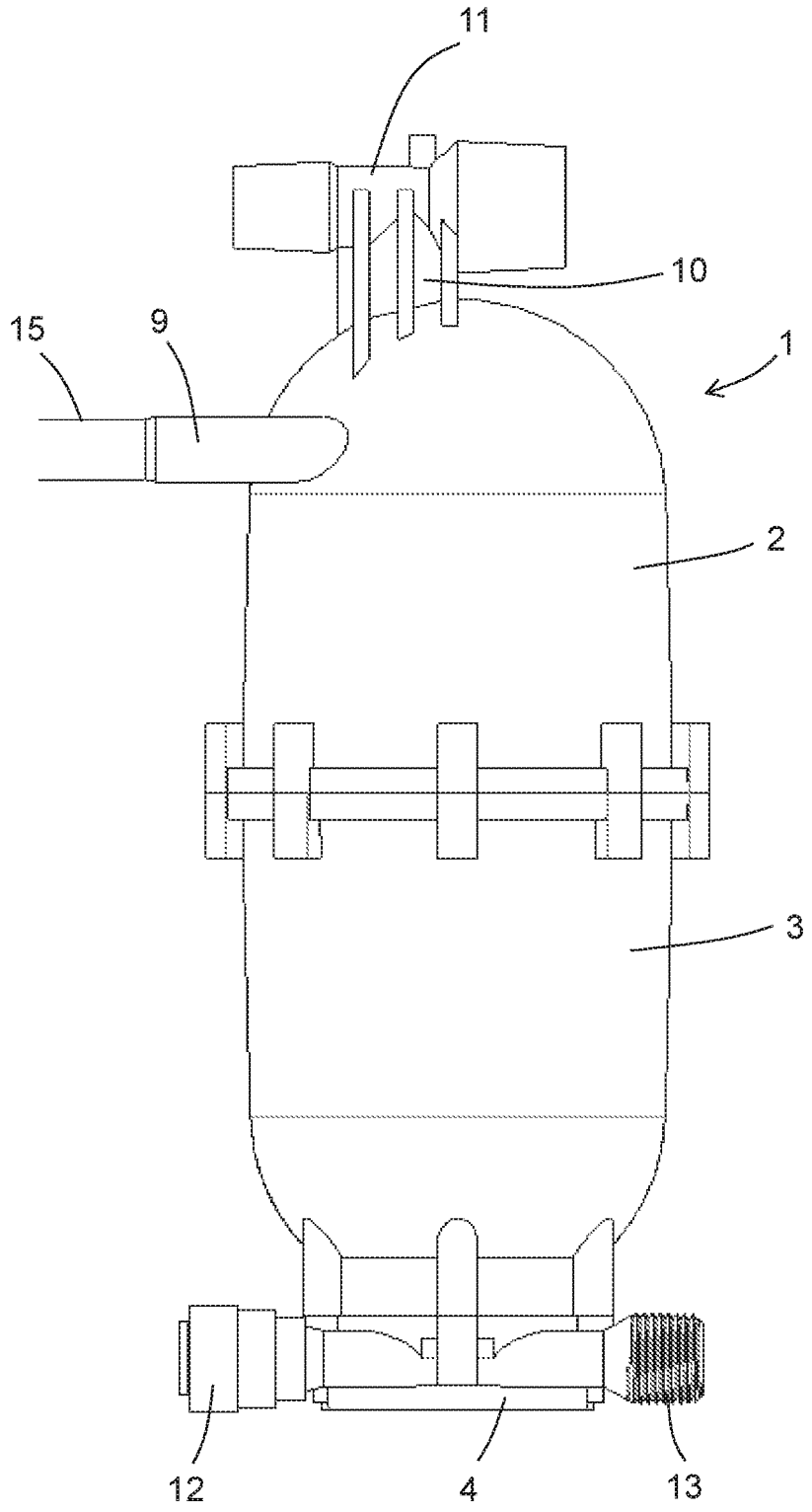
FIG. 2 illustrates the pressure compensation and mixing device of FIG. 1 in a side view.

The pressure compensation and mixing device of the present invention may be realized in different manners. One embodiment is shown in FIGS. 1 and 2 in a sectional and a side view. This embodiment is in particular suited for mobile applications, e.g. for caravans, motorhomes or boats.

The pressure compensation and mixing device has a container unit 1 in which the components for the mixing unit and the pressure compensation unit are arranged. The container unit 1 of the shown example comprises essentially three components, namely an upper part 2, a lower part 3 and a bottom part 4. The parts 2, 3, 4 are screwed, jammed, glued together or the like such that at the respective jointing surfaces a sealed interconnection can be achieved.

The inner contour of the upper part 2 and the lower part 3 is substantially rotationally symmetric and approximates in large part a cylinder. The front sides at the upper end of the upper part 2 and at the lower end of the lower part 3 are also rotationally symmetric in principle—irrespective of minor deviations—and approximate each an inner contour of a hemisphere.

The upper part 2 and the lower part 3 form a mixing container 5 which forms or encompasses a mixing volume 5*a*, in which a fluid, namely in particular water, can be mixed as will be explained in what follows.

Inside of the mixing container 5 a dome-shaped wall 6 is inserted which forms a chamber 7 belonging to the pressure compensation unit. It can be seen from FIG. 1 that the dome-shaped wall 6 extends from the lower end of the lower part 3 upwards and forms the chamber 7, which is closed on its upper side.

At the lower end of the chamber 7 or at the lower end of the lower part 3 several openings 8 are provided over which the mixing container 5 is directly connected with the chamber 7. The water can therefore flow back and for between the mixing container 5 and the chamber 7 through the opening 8.

When filling the mixing container 5 with water, the water consequently enters via the opening 8 also the chamber 7 and rises therein. However, above the water in the chamber 7 a closed air volume 7*a* forms whose pressure rises with the rising water (cf. water line 7*b*) until the pressure ratios are in equilibrium.

If the pressure in the system rises further, the water in the chamber 7 can rise further and can reduce the air volume enclosed therein further. If in contrast the pressure in the system falls also the water level in the chamber 7 will fall and the air volume gets enlarged. FIG. 1 shows the water line 7*b* in a state with high water pressure and hence with small air volume 7*a*.

By this process, a pressure compensation of the whole system can be carried out. In particular, it is possible to reduce, compensate and homogenize pressure peaks which are generated because of outer influences such as fluctuating water supply pressure (strong heating of the water and thus volume expansion in closed system).

A pressure relief valve normally present in the system has to be activated only if a limit pressure threatening for the system is reached. Normal pressure fluctuations which are generated during operation by supplying the water, heating the water and discharging the water can be compensated by the pressure compensation unit in the chamber 7.

Between the water contained in the chamber 7 and the air volume enclosed above it a membrane can be arranged as is known for example from the state of the art. However, as has been proven in practice, such a membrane is not necessary.

Supply of the, e.g. in a heat exchanger (heat exchanger 14*b* in FIG. 3), heated water into the mixing container 5 is carried out via a pipe 15 and an inlet 9 which is arranged in the upper region of the mixing container 5 at the upper part 2.

Discharging of the water is carried out via an outlet 10 which is formed on the upper side of the mixing container 5 and thus on the upper part 2. The outlet 10 allows discharging of the water in axial direction, i.e. along or parallel to a main axis of the mixing container 5, here vertically upwards.

In a not shown variant the outlet 10 extends via an extraction line further into the inside of the mixing container 5 such that the actual extraction position where the water changes from the mixing container 5 into the outlet 10 is located further downwards, separated from the wall of the mixing container 5.

Directly adjoining the outlet 10 a T-piece 11 is provided over which the water discharged from the mixing container 5 can be transmitted in horizontal direction. At the T-piece 11 also a pressure relief valve or safety valve may be applied (right side of FIG. 2) in order to release a dangerous overpressure within the system.

The arrangement of the inlet 9 and the outlet 10 allow for a special form of flow which allows for an effective mixing of the water in the mixing container 5 and thus for example a homogenization of the temperature of the water discharged from the outlet 10.

As can be seen from FIGS. 1 and 2, the inlet 9 is arranged tangentially at the wall of the upper part 2 such that the water flows tangentially into the mixing container 5. Because of the curvature of the inner side of the substantially rotationally symmetrical mixing container 5, the water generates a helical or spiral flow which moves helically downwards to the lower part 3 while rotating around the middle or main axis of the mixing container 5. In this process, the flow flows along the inner side or inner wall of the upper part 2 and the lower part 3.

At the lower end of the lower part 3, the flow maintains its swirl and therefore its circular flow direction, but turns back in the vertical direction such that a helical upward flow on the outer side of the dome-shaped wall 6 inside the mixing container 5 forms until the water flow leaves at the end via the outlet 10 of the mixing container 5.

The flow path which forms in the mixing volume 5*a*, or the mixing container 5 is shown later on the basis of FIG. 10.

The same flow, i.e. first helical flow of the water downwards and then again helical upwards inside the mixing container 5 would also form if no dome-shaped wall 6 or chamber 7 would be provided. Thus, the flow is alone achieved by the arrangement of the inlet 9 and the outlet 10 in connection with the uniform inner contour of the mixing container 5.

In this regard it is not necessary, that the mixing container 5 has an exact rotationally symmetrical, thus e.g. cylindrical or spherical, inner contour as is shown in FIGS. 1 and 2. Just as well it is for example possible that the inner contour resembles an elliptical layout. It is merely necessary that a flow rotating around a middle axis can be achieved.

The flow formed in this manner may also be described as "cyclone-shaped". However, in contrast to cyclone-shaped "air" flows for example in vacuum cleaner filters the flow is used in the present case to achieve an especially effective mixing of the water flowing in through the inlet with the water contained already in the mixing container 5.

The bottom side of the lower part 3 is closed by the bottom part 4 on which connections 12, 13 are located via which the water from the mixing container 5 may be discharged, e.g. in a drainage or into the environment, on demand. This measure serves for example as frost-protection in order to avoid freezing of the water in the mixing container 5.

Due to its own weight the water flows to the lowest point in bottom part 4 and may be discharged from there via the connections 12, 13 to a drainage.

The connections 12 or 13 may lead to a safety discharge valve via which the water may be discharged automatically in case of freezing.

Figure 3A:
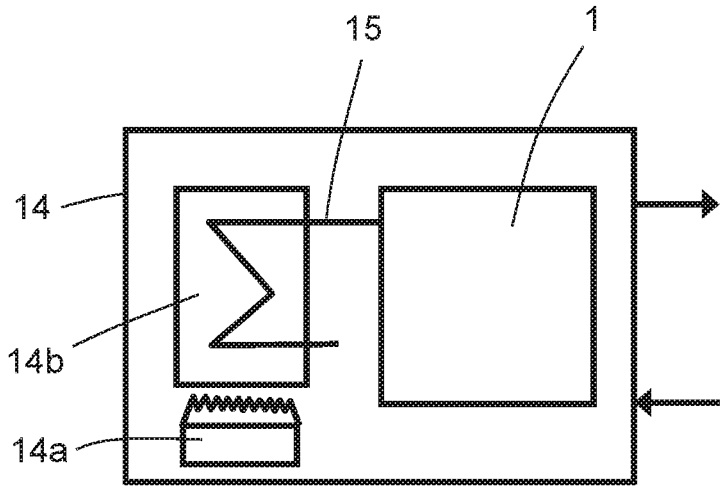
FIGS. 3A and 3B illustrate embodiments of the structure of a fluid heater in schematic illustration.
Figure 3B:
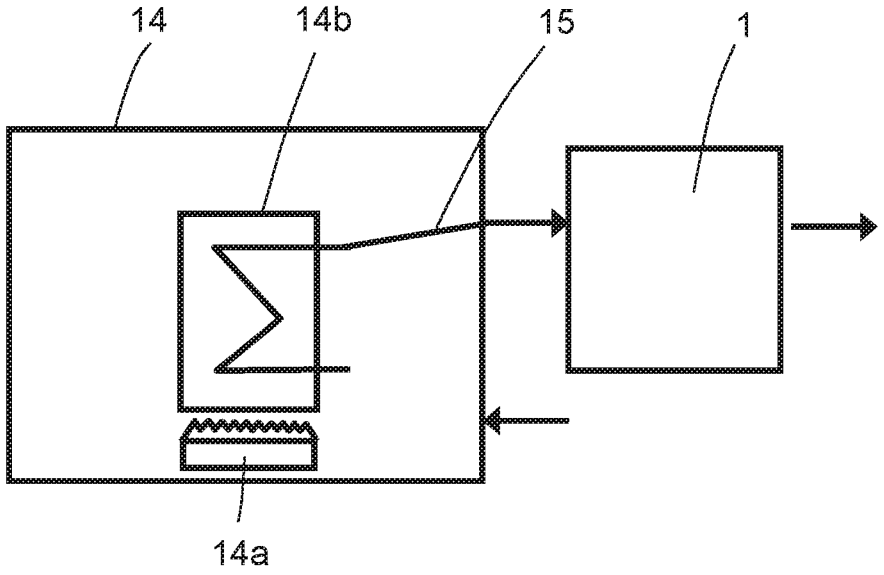

FIG. 3, which includes FIGS. 3*a* and 3*b*, shows two variants of the principle structure of a fluid heater 14 which may be used, e.g. as a constant flow heater, for sanitary systems.

In FIG. 3*a*, the fluid heater 14 has a heat source 14*a*, e.g. a gas burner, for generating heat, which gets transmitted via a heat exchanger 14*b* into a fluid, namely in particular water, flowing through the fluid heater 14. The water is guided via a pipe 15 directly into the container unit 1 which contains or forms the pressure compensation and mixing device.

In the embodiment of FIG. 3*b*, the container unit 1 is arranged distant from the actual fluid heater 14 with the heat exchanger 14*b* and the heat source 14*a*. In this arrangement further components not illustrated in the figure may be provided along the pipe 15.

The fluid heater 14 is particularly suited as a continuous flow heater for mobile applications, thus for example for motorhomes, caravans or boats. To this end, water from the public mains or a storage tank may be supplied heated by means of the heat source 14*a* and the heat exchanger 14*b* as well as homogenized by means of the container unit 1 with the pressure compensation and mixing device with respect to its temperature as well as its pressure.

Figure 4:
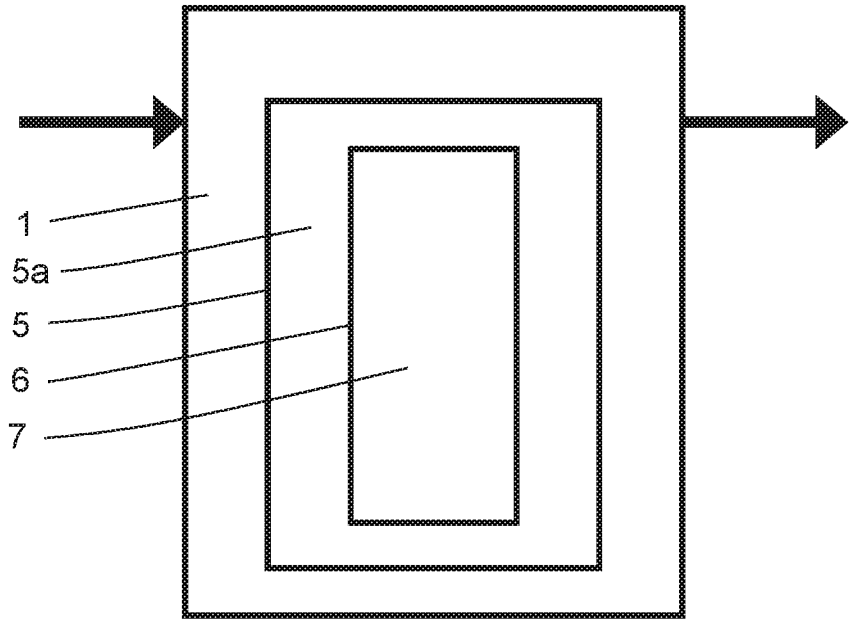
FIG. 4 illustrates the schematic structure of the pressure compensation and mixing device of FIGS. 1 and 2.

FIG. 4 shows the principle structure of the device of FIG. 1 in a schematic illustration, wherein inside the container unit 1, the mixing volume 5*a* or the mixing container 5 and the chamber 7 carrying out the pressure compensation are arranged.

Figure 5:
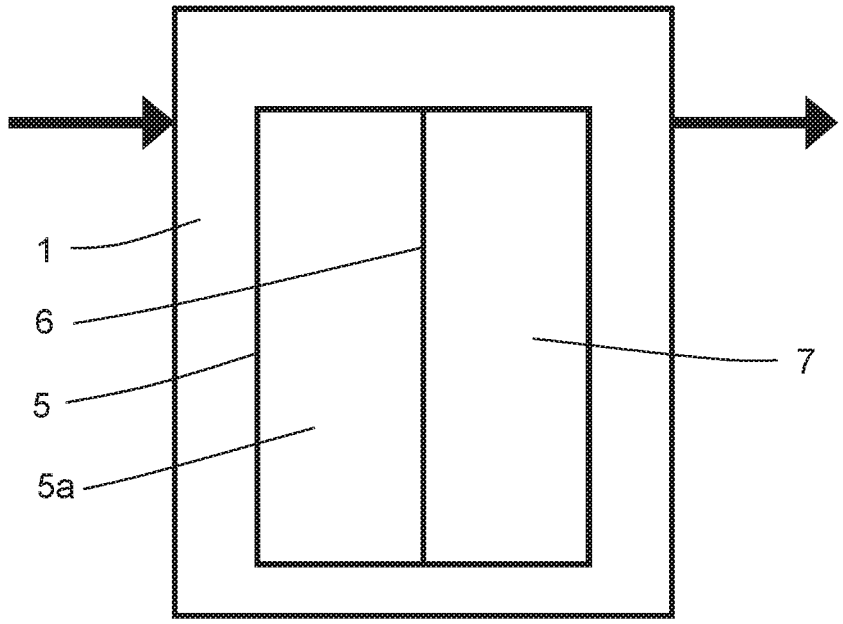
FIG. 5 illustrates another embodiment of a pressure compensation and mixing device in schematic illustration.

A variant to the structure is shown in FIG. 5 according to which the chamber 7 with the pressure compensation volume is not arranged inside the mixing volume 5*a* (mixing container 5) (as for example shown in FIGS. 1 and 4), but next to it. Also in this case, it is possible and appropriate that the volumes in the mixing volume 5*a* or the mixing container 5 and in the chamber 7 are directly connected with each other such that water can flow back and forth between the volumes.

Figure 6:
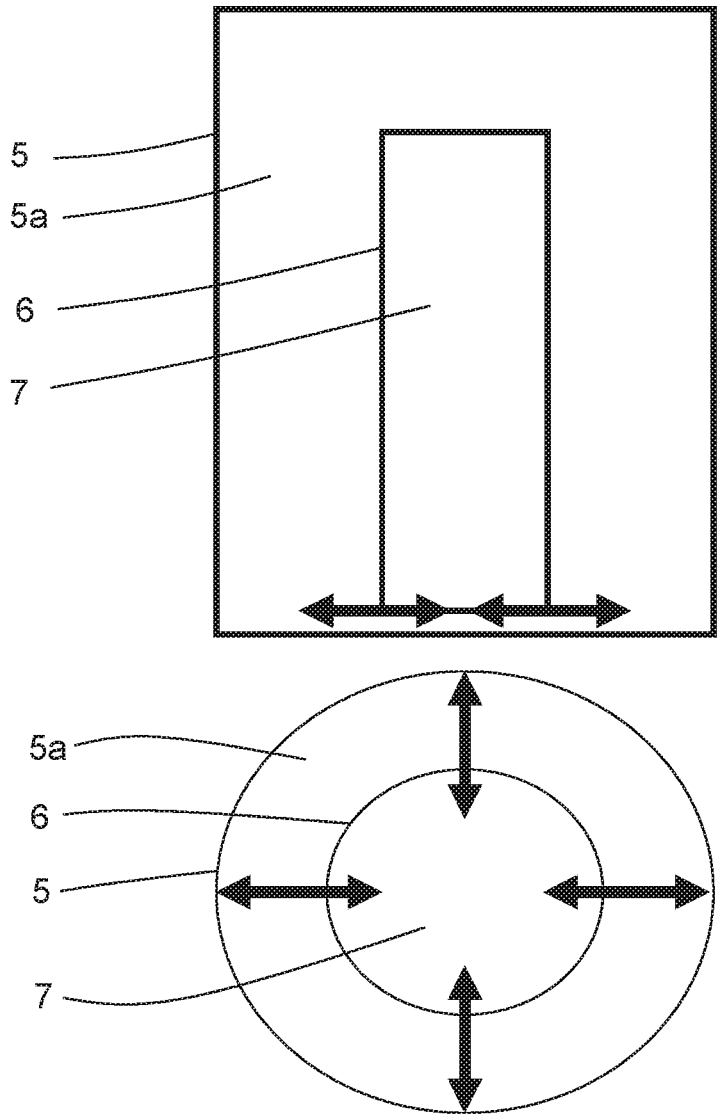
FIG. 6 illustrates an embodiment of the structure of FIG. 4 in side view and a top view.

The principle structure of the device of FIG. 1 is also illustrated by means of FIG. 6, wherein in the upper part of FIG. 6 the device is shown in schematic cross-sectional side view and is shown in the lower part in a cross-sectional top view. The arrows illustrate the possibility of flow of the water for compensation between the mixing container 5 and the chamber 7.

Figure 7:
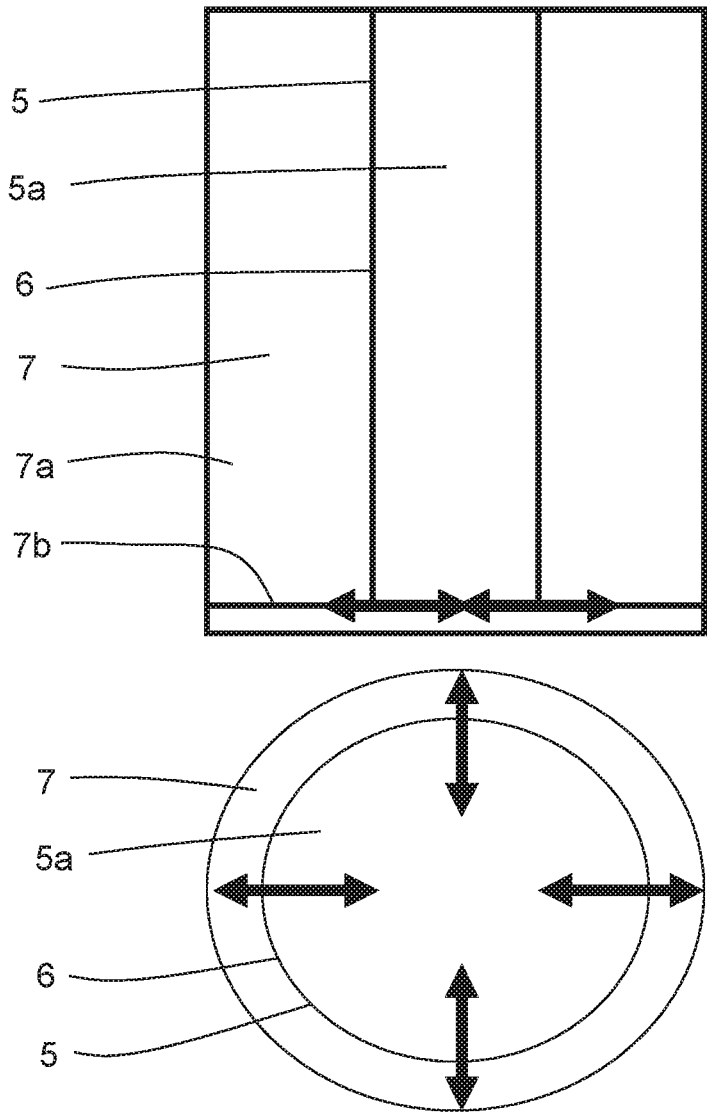
FIG. 7 illustrates another embodiment of the structure of FIG. 6 in schematic side view and top view.

FIG. 7 shows a variant of the embodiment of FIG. 6 for which the locations of the mixing volume 5*a* with the mixing container 5 and the chamber 7 are exchanged. Accordingly, the mixing container 5 is arranged inside the chamber 7, which encompasses the mixing container 5. Also in this case, the arrows show a possible compensating flow between the mixing container 5 and the chamber 7.

The chamber 7 is—since it is completely closed towards its top—substantially only filled by air (air volume 7*a*). Merely in the lower part, into which the water from the mixing container 5 or the mixing volume 5*a* flows in, water is located, which rises only slightly upwards in the circular chamber 7 (water line 7*b*).

By this arrangement it is achieved that the air volume 7*a* contained in chamber 7 performs a certain isolation effect with respect to the water containing mixing container 5. This is on the one hand advantageous for maintaining the temperature of the heated water contained in the mixing container 5. On the other hand, the air volume 7*a* in the chamber 7 may also enhance the frost protection due to the isolation effect.

Figure 8:
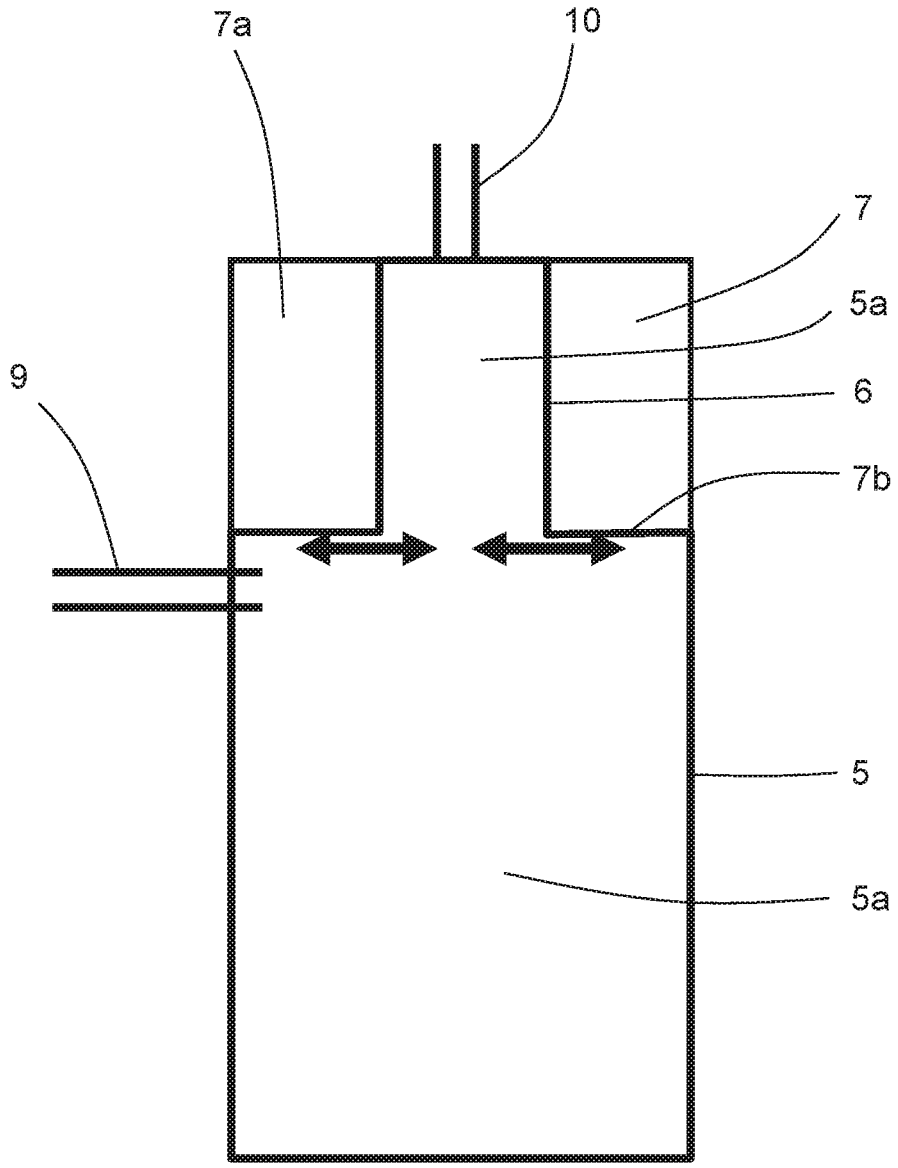
FIG. 8 illustrates a variant of the embodiment of FIG. 7.

FIG. 8 shows a variant of the embodiment of FIG. 7.

In a closed container (mixing container 5) the mixing volume 5*a* is formed. In the upper region a pipe-shaped input is provided which forms the wall 6. The inlet 9 into the mixing volume 5*a* is arranged approximately at the height of the lower edge of the wall 6, while the outlet 10—as is also the case for some of the embodiments described above—is formed at the upper frontal end of the mixing container 5.

Due to the fact, that the mixing container 5 is overall closed except for the inlet 9 and the outlet 10 the downwardly open chamber 7 in which the air volume 7*a* may be formed is formed outside around the wall 6. Namely, when filling the mixing container 5 with water for the first time, the air contained in the mixing container 5 is displaced at first and is expelled in particular through the outlet 10. However, a part of the air remains in the circular chamber 7 as it is—hindered by the pipe-shaped wall 6—not able to flow towards the outlet 10. This air cushion serves as the air volume 7*a* for the later pressure compensation in the fluid. The water line 7*b* indicates the interface between the remaining air volume 7*a* and the water in the rest of the mixing container 5.

Figure 9:
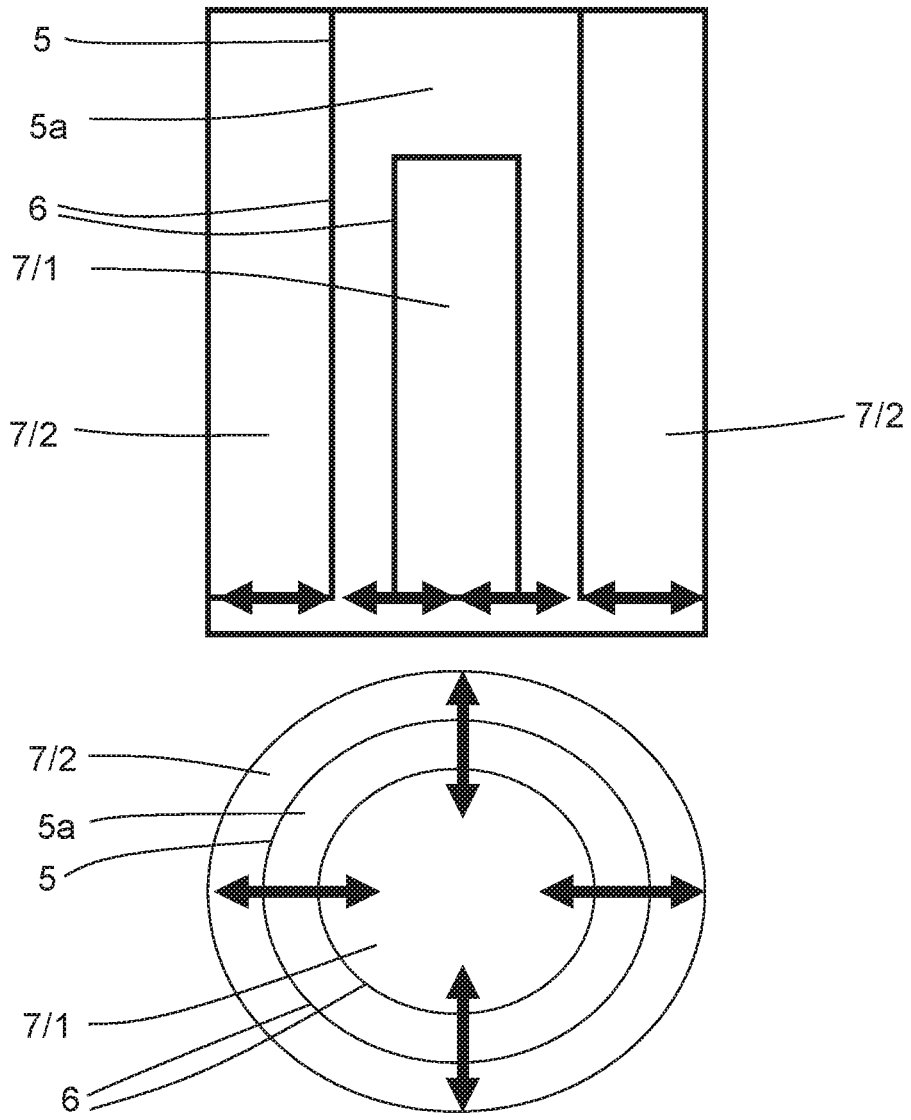
FIG. 9 illustrates a further embodiment of the structure of FIGS. 6 and 8 in schematic illustration.

FIG. 9 shows an embodiment which corresponds to the combination of the embodiments of FIGS. 6 and 8. Here, inside the mixing container 5 or the mixing volume 5*a* a chamber 7/1 is arranged. The mixing container 5 itself is encompassed by a second outer chamber 7/2.

In this manner, the positive effects of the embodiments of FIGS. 6 and 7 may be combined with each other. On the one hand, the isolation effect of the air cushion and the outer chamber 7/2 is used to largely preserve the water temperature in the mixing container 5. On the other hand the arrangement of the inner chamber 7/1 may support the advantageous cyclone flow inside the mixing containers 5, thus inside the mixing volume 5*a*.

In the variants shown in FIG. 4 as well as 6, 8, and 9, the mixing container 5 and the chamber(s) 7 are arranged each concentrically with respect to each other. As "concentric" an arrangement should be understood also then, if the basic form of the mixing container 5 and the chamber 7 is not cylindrical, but for example elliptical, which should correspond in the above meaning to a rotationally symmetrical inner contour just as well.

In all the variants shown here the arrangement of the tangential inlet 9 and the axial outlet 10 on the mixing container 5 and the mixing volume 5*a* may be maintained in order to obtain the helical cyclone flow.

The mixing of the water in the mixing container 5 or the mixing volume 5*a* downstream of the heat exchanger 14*b* has been proven as very advantageous. As already discussed above, the problem exists that when heating the heat exchanger 14*b* by means of a gas burner or an electric heating heat will be introduced via the heat exchanger 14*b* also then into the water contained inside the heat exchanger 14*b* if the water flow has already been stopped, for example because the user stopped the water flow on the tap connection. The heat can also come from the material (for the most part metal) stored in the heat exchanger 14*b*. Just as well, the heat may for example also be introduced by the gas burner which shuts down only with a certain time offset.

In particular in case of smaller fluid heaters 14 and hence also smaller dimensioned heat exchangers 14*b* relatively little water is contained in the heat exchanger 14*b* such that already a little amount of excess heat can lead to a strong heating of the water. Temperature increases of 20 Kelvin are not unusual in this case. For a user who wants for example to extract hot water for a shower such a sudden temperature change may be highly inconvenient.

However, by means of the pressure compensation and mixing device arranged downstream of the heat exchanger 14*b*, in particular by means of the mixing container 5, it is possible to mix at a restart the hot water flowing from the heat exchanger 14*b* via the inlet into the mixing container 5 with the significantly cooler water already contained in the mixing container 5 and to obtain in this manner a homogenization of the temperature with an only moderate temperature rise at the outlet.

In the mixing unit, i.e. in the mixing container 5 and the mixing volume 5*a*, the mechanical energy of the fluid flow is used to obtain a multiple mixing of the inflowing hot water volume flow with the cooler container water before the outflow. This mixing results from a temporal and/or spatial offset between the inflowing and the outflowing volume flow inside the mixing container 5.

Measurements have proven that already for a small volume of the mixing container 5, constituting a buffer container in this respect, of for example 1 to 2 liter a very effective homogenization of the outlet temperature may be achieved. The temperature rising amounts for example merely to maximal 1 Kelvin (instead of 20 Kelvin) and is therefore also not received as disturbing by a user.

A condition for the effective temperature homogenization despite the small dimensioned mixing container 5 is that the water in the mixing container 5 gets mixed between the inlet 9 and the outlet 10 very effectively. Inevitable temperature gradients should be leveled so far that the temperature at the outlet 10 conducts only small variations. This mixing can be achieved by the cyclone mixer (FIGS. 10, 11) or the jet mixer (FIG. 12) described in the following.

Figure 10:
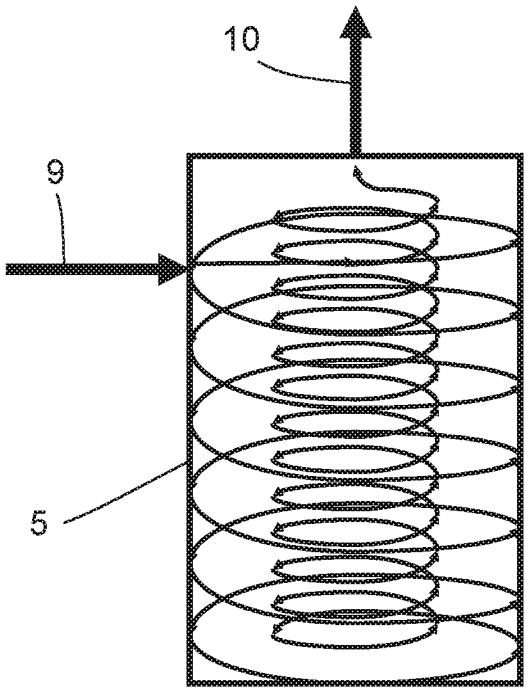
FIG. 10 illustrates the cyclone flow principle in the mixing volume of the pressure compensation and mixing device of FIGS. 1 and 2.

The so-called cyclone flow or swirl flow is shown by example of the cyclone mixer of FIG. 10 schematically.

As already described above, the water heated by the fluid heater or the heat exchanger 14 flows in via the laterally offset and hence substantially tangentially arranged inlet 9 and performs a helical swirl flow which extends vertically from top to bottom in the mixing volume 5*a* and the mixing container 5 on its inner wall. After reaching the bottom of the mixing container 5 the vertical direction gets inverted and the flow takes place from bottom to top with smaller radius inside the mixing container 5 helically (cyclone or swirl flow) until the water gets discharged via the outlet 10.

In the embodiment shown in FIG. 10 the inlet 9 and the outlet 10 are arranged in the upper region of the mixing container 5. In other variants, also other embodiments are possible.

Figure 11A:
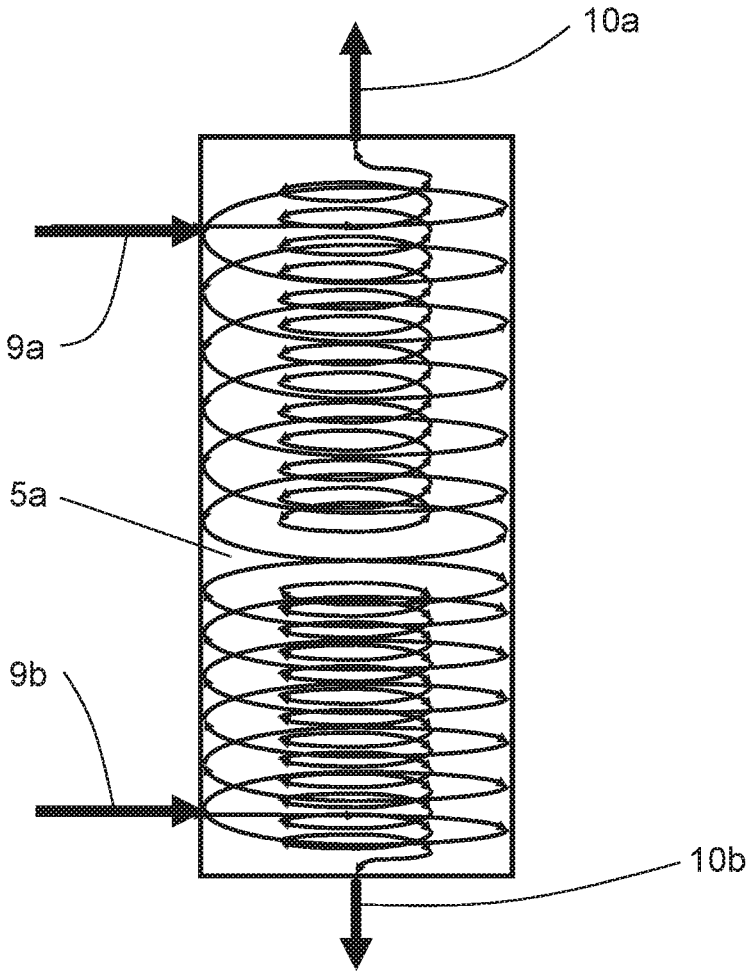
FIGS. 11A and 11B illustrate further examples of cyclone flow in the mixing volume.
Figure 11B:
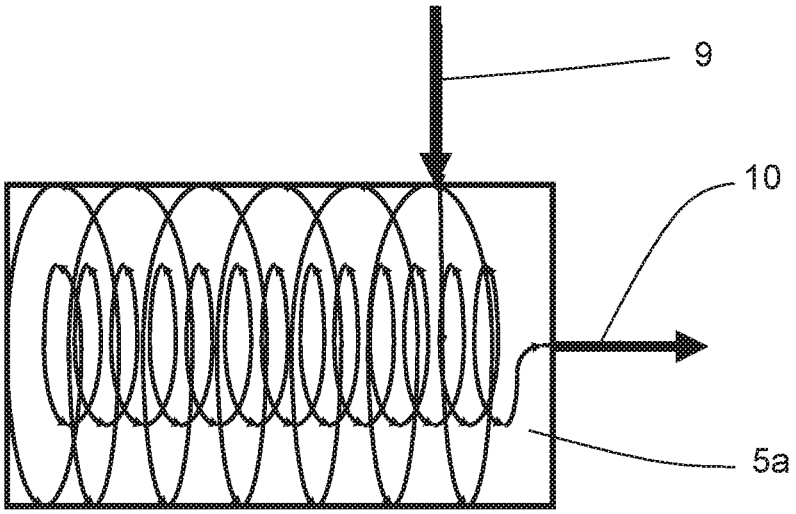

For example FIG. 11, which includes FIGS. 11*a* and 11*b*, shows embodiments with several in- and outlets (FIG. 11*a*) and with a mixing container 5 in a horizontal arrangement (FIG. 11*b*), respectively.

According to FIG. 11*a*, two inlets 9 and two outlets 10, namely one each in the upper region and in the lower region, are to be arranged. Hence, an inlet 9*a* and an outlet 10*a* are provided in the upper region of the mixing volume 5*a*, while in the lower region a further inlet 9*b* and a further outlet 10*b* are arranged. In this case, two cyclone flows form in the mixing container 5, which meet each other in the middle of the mixing container 5 before they diverge again as shown in FIG. 11*a*).

In a further variant shown in FIG. 11*b*, the mixing container 5 may also be arranged such that its main or central axis extended substantially horizontally. The cyclone flow forms then accordingly and proceeds with horizontal main direction.

In another not shown variant the inlet 9 and the outlet 10 may also be provided in the lower region of the mixing container 5 such that the helical cyclone flow extends first upwards and then downwards again.

Figure 12:
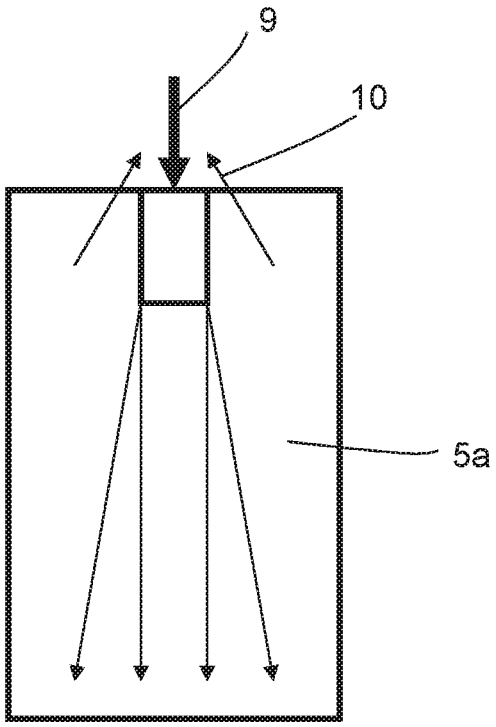
FIG. 12 illustrates another embodiment of a flow and mixing principle in the mixing volume in a pressure compensation and mixing device.

FIG. 12 shows an alternative to the cyclone mixer of FIG. 10.

In this case, the inlet 9 and the outlet 10 are arranged on the mixing container concentrically with respect to each other such that a merely axial inflow and a merely axial outflow of the water results.

In particular, the water gets introduced via the centrally arranged inlet 9 into the mixing container 5 and the mixing volume 5*a*. The outlet 10 may for example encompass the inlet 9 circularly such that the water may be discharged also in the desired manner axially.

Also with this mixer an effective mixing of the water in the mixing container and thus the mixing volume 5*a* may be effected.

Spatially relative terms such as "under", "below", "lower", "over", "upper" and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open-ended terms that indicate the presence of stated elements or features, but do not preclude additional elements or features. The articles "a", "an" and "the" are intended to include the plural as well as the singular, unless the context clearly indicates otherwise.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A pressure compensation and mixing device for a fluid heater, comprising:

a mixing unit configured to mix a fluid guided in the mixing unit; and a pressure compensation unit configured to restrict pressure rising in the fluid, wherein the mixing unit and the pressure compensation unit are integrated in a container unit, wherein a bottom side of the container unit is closed by a bottom portion on which at least one connection is located via which the fluid may be discharged, wherein the container unit has an inlet and an outlet, wherein the container unit comprises a mixing container, wherein the outlet is arranged in an upper region of the mixing container, wherein the inlet is arranged in the upper region of the mixing container, wherein the inlet is tangentially arranged on a mixing volume of the mixing unit such that a fluid entering through the inlet flows into the mixing volume tangentially, wherein the outlet is axially arranged on the mixing volume such that a fluid exiting through the outlet flows out of the mixing volume axially, and wherein the pressure compensation unit is arranged at least partly inside of the mixing unit, wherein the pressure compensation unit has a pressure compensation volume and a chamber with several openings for receiving the pressure compensation volume, wherein the several openings are provided in a lower region of the chamber such that in an upper region of the chamber above the several openings, the pressure compensation volume is includable as air volume, wherein the chamber has direct connection with the mixing volume of the mixing unit via the several openings, wherein the chamber and the mixing volume are arranged concentrically with respect to each other, wherein a dome-shaped wall extends from the lower end of the lower portion upwards and forms a chamber of the pressure compensation unit, wherein the dome-shaped wall is closed on an upper side of the dome-shaped wall.

2. The pressure compensation and mixing device of claim 1, wherein the mixing unit is a swirl mixing unit comprising a swirl generating unit configured to generate a swirl flow of the fluid in a mixing volume of the mixing unit.

3. The pressure compensation and mixing device of claim 1, wherein the outlet is provided at a top side of the mixing volume such that the fluid exits vertically upward out of the mixing volume, and wherein the inlet is provided in an upper region of the mixing volume on a lateral surface of the mixing container encompassing the mixing volume.

4. The pressure compensation and mixing device of claim 1, wherein the fluid in the mixing volume of the mixing unit has a flow along a flow path selected from the group consisting of a swirl flow, a spiral flow, a helical flow, and a cyclone flow.

5. The pressure compensation and mixing device of claim 1, wherein the mixing container is shaped such that a fluid in the mixing volume of the mixing unit has a helical swirl flow in a vertical direction which extends from top-to-bottom in the mixing container, and after reaching the bottom of the mixing container, the vertical direction of the helical swirl flow is inverted such that the helical swirl flow occurs from bottom-to-top with a smaller radius inside the mixing container until the water is discharged.

6. The pressure compensation and mixing device of claim 1, wherein:

the mixing unit is a jet mixing unit;

the jet mixing unit has the mixing volume, the inlet arranged at a side of the mixing volume, and the outlet arranged at the same side of the mixing volume as the inlet; and the inlet and the outlet are arranged coaxially with respect to each other such that either the inlet encompasses the outlet circularly or the outlet encompasses the inlet circularly.

7. The pressure compensation and mixing device of claim 1, wherein the chamber is arranged inside of the mixing volume.

8. The pressure compensation and mixing device of claim 1, wherein the mixing container is formed by an upper portion and a lower portion, and wherein the dome-shaped wall extends inside of the lower portion and the upper portion.

9. A fluid heater, comprising:

a pressure compensation and mixing device comprising a mixing unit configured to mix a fluid guided in the mixing unit and a pressure compensation unit configured to restrict pressure rising in the fluid, the mixing unit and the pressure compensation unit being integrated in a container unit, a bottom side of the container unit being closed by a bottom portion on which at least one connection is located via which the fluid may be discharged, the container unit having an inlet and an outlet, wherein the container unit comprises a mixing container, wherein the outlet is arranged in an upper region of the mixing container;

a heat source configured to generate heat;

a heat exchanger configured to transmit the heat to a fluid flowing through the heat exchanger; and a guiding unit configured to guide the fluid from the heat exchanger to the pressure compensation and mixing device, wherein the inlet of the container unit is arranged in the upper region of the mixing container, wherein the inlet of the container unit is tangentially arranged on a mixing volume of the mixing unit such that a fluid entering through the inlet flows into the mixing volume tangentially, wherein the outlet of the container unit is axially arranged on the mixing volume such that a fluid exiting through the outlet flows out of the mixing volume axially, and wherein the pressure compensation unit is arranged at least partly inside of the mixing unit, wherein the pressure compensation unit has a pressure compensation volume and a chamber with several openings for receiving the pressure compensation volume, wherein the several openings are provided in a lower region of the chamber such that in an upper region of the chamber above the several openings, the pressure compensation volume is includable as air volume, wherein the chamber has direct connection with the mixing volume of the mixing unit via the several openings, wherein the chamber and the mixing volume are arranged concentrically with respect to each other, wherein a dome-shaped wall extends from the lower end of the lower portion upwards and forms a chamber of the pressure compensation unit, wherein the dome-shaped wall is closed on an upper side of the dome-shaped wall.

10. The fluid heater of claim 9, wherein the guiding unit is configured to guide the fluid from the heat exchanger to the inlet at the mixing volume.

11. The fluid heater of claim 9, wherein the pressure compensation and mixing device is arranged downstream of the heat exchanger and wherein the guiding unit comprises a pipe directly guiding the fluid from the heat exchanger to the container unit.

* * * * *